US010856643B2

(12) United States Patent
Hwang

(10) Patent No.: US 10,856,643 B2
(45) Date of Patent: Dec. 8, 2020

(54) DOUBLE HAIR COSMETIC BRUSH

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 0 days.

(21) Appl. No.: 16/300,456

(22) PCT Filed: May 8, 2017

(86) PCT No.: PCT/KR2017/004774
§ 371 (c)(1),
(2) Date: Nov. 9, 2018

(87) PCT Pub. No.: WO2017/200230
PCT Pub. Date: Nov. 23, 2017

(65) Prior Publication Data

US 2019/0142146 A1 May 16, 2019

(30) Foreign Application Priority Data

May 16, 2016 (KR) ..... 10-2016-0059657

(51) Int. Cl.
*A46B 5/00* (2006.01)
*A46B 11/00* (2006.01)
*A46B 9/02* (2006.01)

(52) U.S. Cl.
CPC ..... *A46B 5/0008* (2013.01); *A46B 5/0012* (2013.01); *A46B 9/02* (2013.01); *A46B 11/001* (2013.01); *A46B 2200/1046* (2013.01)

(58) Field of Classification Search
CPC ..... A46B 5/0008; A46B 5/0012; A46B 9/02; A46B 11/001; A46B 2200/1046
See application file for complete search history.

(56) References Cited

U.S. PATENT DOCUMENTS

| | | | | |
|---|---|---|---|---|
| 1,694,364 | A * | 12/1928 | Albright | A46B 15/00 15/192 |
| 3,309,727 | A * | 3/1967 | Snodderly | A46B 15/00 15/160 |
| 6,224,287 | B1 * | 5/2001 | Gieux | A45D 33/34 15/207.2 |
| 9,326,589 | B2 * | 5/2016 | Nakamura | A46B 9/021 |
| 9,635,927 | B2 * | 5/2017 | Godin | A46B 9/021 |
| 2005/0045200 | A1 | 3/2005 | Zeunik | |

(Continued)

FOREIGN PATENT DOCUMENTS

| | | | |
|---|---|---|---|
| JP | 2016-032614 | A | 3/2016 |
| KR | 10-2011-0056488 | A | 5/2011 |

*Primary Examiner* — Dung Van Nguyen
(74) *Attorney, Agent, or Firm* — Heedong Chae; Lucem, PC

(57) ABSTRACT

Disclosed is a double hair cosmetic brush. The double hair cosmetic brush of the present invention includes a brush body; a first brush hair portion provided at one side of the brush body; and a second brush hair portion provided on the brush body to surround a border of the first brush hair portion, in which a receiving groove in which the cosmetic is received is provided in at least one of the first brush hair portion and the second brush hair portion and the hair of the second brush hair portion is thinner than the hair of the first brush hair portion.

3 Claims, 4 Drawing Sheets

(56) References Cited

U.S. PATENT DOCUMENTS

| | | | | |
|---|---|---|---|---|
| 2007/0177930 | A1* | 8/2007 | Byun | A45D 33/02<br>401/280 |
| 2010/0239358 | A1 | 9/2010 | Sturgis | |
| 2014/0325775 | A1 | 11/2014 | Nakamura et al. | |
| 2015/0265039 | A1 | 9/2015 | Godin et al. | |

* cited by examiner

DOUBLE HAIR COSMETIC BRUSH

CROSS-REFERENCE TO RELATED APPLICATIONS

This application is based on and claims the benefit of priority to Korean patent application no. 10-2016-0059657 filed on May 16, 2016, with the Korean Intellectual Property Office, the disclosure of which is incorporated herein by reference.

FIELD OF THE INVENTION

The present invention relates to double hair cosmetic brush, and more particularly, to a double hair cosmetic brush in which brush hairs are doubly provided and cosmetics are received in the brush hair itself.

BACKGROUND ART

In general, cosmetics used for make-up are a liquid, a solid, and a mixed state of the liquid and the solid. Among them, in order to apply the solid cosmetics on the face, brushes having various shapes and sizes have been developed and used.

That is, the above-described brush is provided so that the cosmetic made of solid powder may be coated on a hair of the brush to be properly applied on the face and the like. Such a brush may be constituted by a handle which may be held by a user and a brush hair provided at the front end of the handle and made of a plurality of hairs.

A previous brush hair is made of hairs for a general foundation or micro hairs to have a shortcoming to cover pores of the skin everywhere while spreading cosmetics including a foundation on the entire face. As a result, improvement measures thereof are required.

The above-described technical configuration is a background technique for assisting the understanding of the present invention, and does not mean a conventional technology widely known in the art to which the present invention belongs.

DISCLOSURE

Technical Problem

Therefore, an object of the present invention to be achieved is to provide a double hair cosmetic brush capable of covering pores of the skin everywhere while spreading cosmetics on the entire face.

Technical Solution

According to an aspect of the present invention, there is provided a double hair cosmetic brush including a brush body; a first brush hair portion provided at one side of the brush body; and a second brush hair portion provided on the brush body to surround a border of the first brush hair portion, in which a receiving groove in which the cosmetic is received is provided in at least one of the first brush hair portion and the second brush hair portion and the hair of the second brush hair portion is thinner than the hair of the first brush hair portion.

The first brush hair portion may include a first brush hair provided in the brush body and having a plurality of foundation hairs; and the receiving groove provided on an upper surface of the first brush hair to receive cosmetics including a foundation.

At least one of the receiving groove may be provided at the center of the first brush hair.

The second brush hair portion may include micro hairs.

The first brush hair portion and the second brush hair portion may have a water droplet shape.

Advantageous Effects

According to the exemplary embodiments of the present invention, a receiving groove in which the cosmetic is received is provided in at least one of a first brush hair portion and a second brush hair portion and the cosmetic may be spread on the entire face while the cosmetic including a foundation is received in the receiving groove.

Further, the hair of the second brush hair portion is thinner than the hair of the first brush hair portion to permeate and spread the cosmetic applied to the face into the pores everywhere by the first brush hair portion.

MODES OF THE INVENTION

Figure 1:
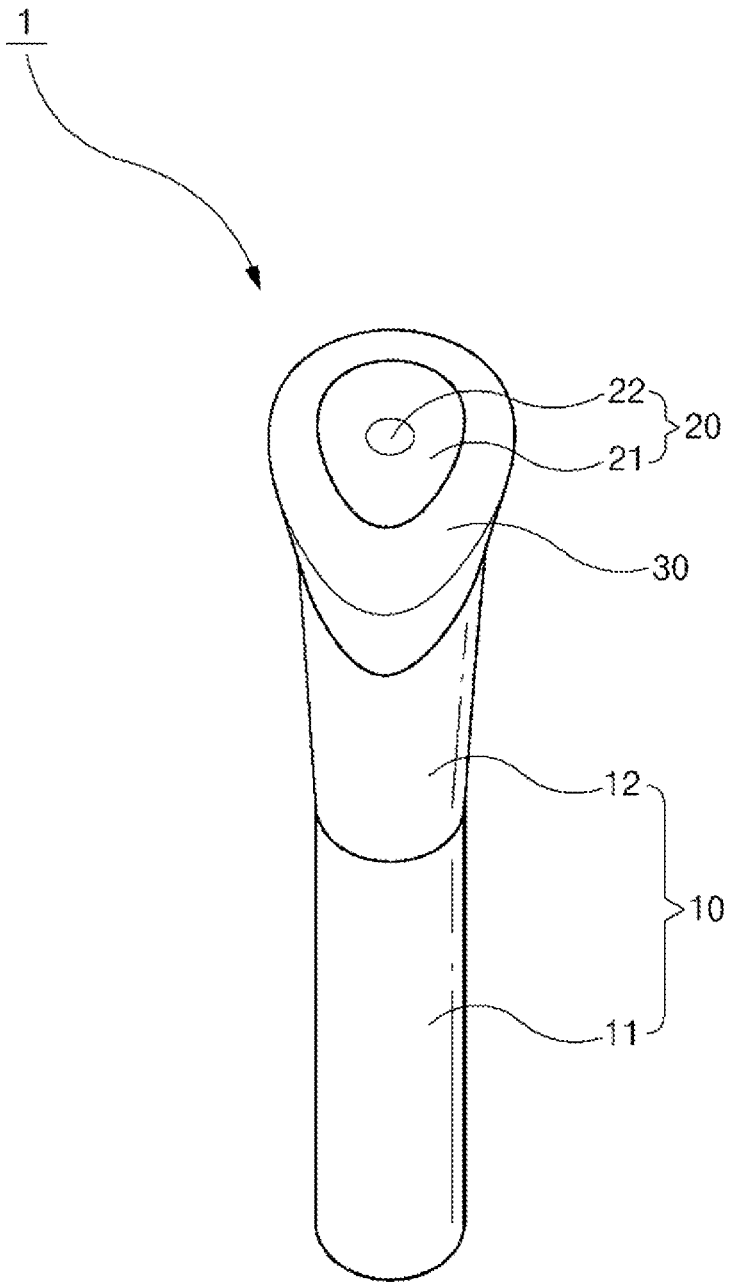
FIG. 1 is a diagram schematically illustrating a double hair cosmetic brush according to an exemplary embodiment of the present invention.

In order to fully understand the present invention, operational advantages of the present invention and objects achieved by implementing the present invention, the prevent invention will be described with reference to the accompanying drawings which illustrate preferred embodiments of the present invention and the contents illustrated in the accompanying drawings.

Hereinafter, preferred exemplary embodiments of the present invention will be described in detail with reference to the accompanying drawings. Like reference numerals illustrated in the respective drawings designate like members.

Figure 2:
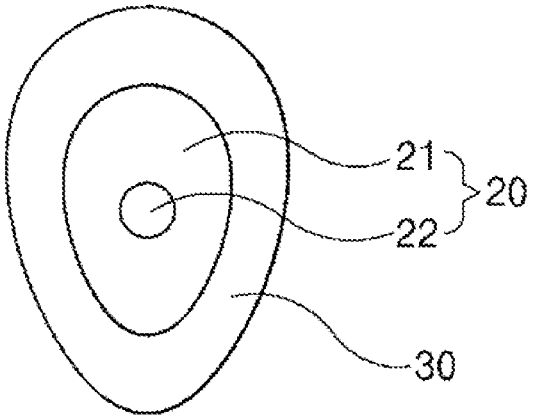
FIG. 2 is a plan view of FIG. 1.
Figure 3:
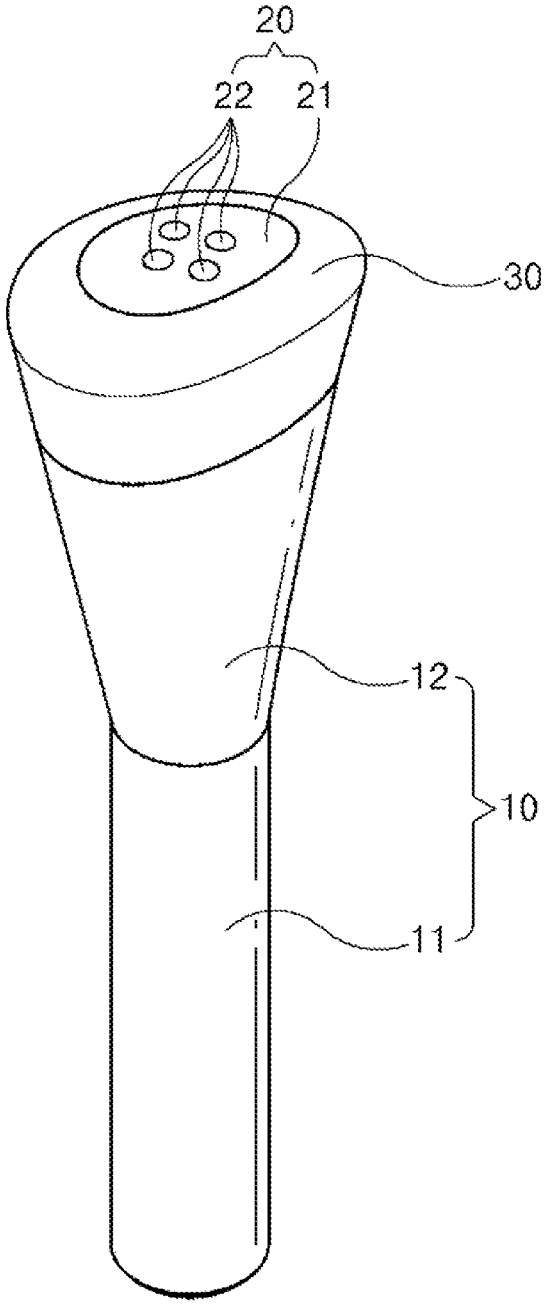
FIG. 3 is a diagram illustrating a plurality of receiving grooves illustrated in FIG. 1.
Figure 4:
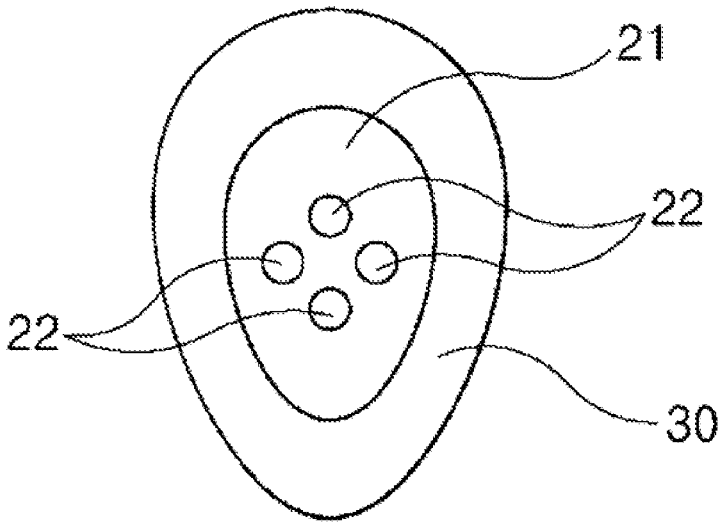
FIG. 4 is a plan view of FIG. 3.

FIG. 1 is a diagram schematically illustrating a double hair cosmetic brush according to an exemplary embodiment of the present invention, FIG. 2 is a plan view of FIG. 1, FIG. 3 is a diagram illustrating a plurality of receiving grooves illustrated in FIG. 1, and FIG. 4 is a plan view of FIG. 3.

As illustrated in these drawings, a double hair cosmetic brush 1 according to the exemplary embodiment includes a brush body 10, a first brush hair portion 20 provided on one side of the brush body 10, and a second brush hair portion 30 provided on the brush body 10 so as to surround a border of the first brush hair portion 20.

As illustrated in FIG. 1, the brush body 10 includes a handle 11 provided as a holding place of a user and a brush holder 12 of which a lower portion is coupled to the handle 11 to fix the first brush hair portion 20 and the second brush hair portion 30.

The handle 11 of the brush body 10 may be made of wood or metal.

The brush holder 12 of the brush body 10 may be made of a metal material and the lower end of the brush holder 12 may be pressed and coupled to the handle 11 using a pressing device such as a press while being fitted in the handle 11 or coupled to the handle 11 using a known adhesive.

As illustrated in FIG. 1, the first brush hair portion 20 may be coupled to the brush holder 12 to be surrounded by the second brush hair portion 30.

In the exemplary embodiment, as illustrated in FIGS. 1 and 2, the first brush hair portion 20 includes a first brush hair 21 provided with general foundation hairs and a receiving groove 22 provided in the first brush hair 21 to be provided as a receiving place of the cosmetic.

As illustrated in FIG. 2, the first brush hair 21 of the first brush hair portion 20 may have a water droplet shape in a plane shape. In this case, it is possible to give aesthetic sense and a soft touch feeling.

In the exemplary embodiment, the first brush hair 21 and the second brush hair portion 30 may be fixed to the inside of the brush holder 12 using an adhesive, a ring member, or the like.

As illustrated in FIG. 1, one receiving groove 22 of the first brush hair portion 20 may be provided at the center of the first brush hair 21, and as illustrated in FIG. 3, a plurality of receiving grooves is provided to be provided as a receiving place of the cosmetics including a foundation.

In the exemplary embodiment, when the cosmetics are applied, the foundation is received in the receiving groove 22 illustrated in FIGS. 1 and 3 and then easily spread on the entire face.

As illustrated in FIGS. 1 and 3, the second brush hair portion 30 is provided to surround the border of the first brush hair portion 20, thereby permeating the cosmetics into the pores everywhere.

In the exemplary embodiment, the second brush hair portion 30 may have a micro hair, for example, a thickness of 0.5 mm.

Further, in the exemplary embodiment, the second brush hair portion 30 may have a water droplet shape in a plane shape like the first brush hair portion 20.

As described above, in the exemplary embodiment, the receiving groove in which the cosmetic is received is provided in at least one of the first brush hair portion and the second brush hair portion and the cosmetic may be spread on the entire face while the cosmetic including a foundation is received in the receiving groove.

Further, the hair of the second brush hair portion is thinner than the hair of the first brush hair portion to permeate and spread the cosmetic applied to the face into the pores everywhere by the first brush hair portion.

The present invention is not limited to the exemplary embodiments described herein, and it would be apparent to those skilled in the art that various changes and modifications might be made without departing from the spirit and the scope of the present invention. Therefore, it will be determined that the changed examples or modified examples are included in the appended claims of the present invention.

What is claimed is:

1. A double hair cosmetic brush comprising:

a brush body;

a first brush hair portion provided in the brush body wherein the first brush hair portion includes a first brush hair having plurality of foundation hairs and a receiving groove provided on an upper surface of the first brush hair to receive cosmetics including a foundation; and a second brush hair portion provided on the brush body to surround a border of the first brush hair, wherein the second brush hair portion includes micro hairs, wherein the first brush hair and an area of the first brush hair in contact with the micro hairs are the same height.

2. The double hair cosmetic brush of claim 1, wherein at least one of the receiving groove is provided at the center of the first brush hair.

3. The double hair cosmetic brush of claim 1, wherein the first brush hair portion and the second brush hair portion have a water droplet shape.

* * * * *